US011512449B2

(12) United States Patent
Cairns et al.

(10) Patent No.: US 11,512,449 B2
(45) Date of Patent: Nov. 29, 2022

(54) HYDRAULIC CONTROL SYSTEM AND METHOD FOR A BUCKET SHAKE OPERATION IN A WORK MACHINE WITH A HYDRAULIC PUMP AND UNLOADER VALVE

(71) Applicant: Caterpillar SARL, Geneva (CH)

(72) Inventors: Paul John Cairns, Leicestershire (GB); Fuaad Sayeed, Dunlap, IL (US); Arick M. Bakken, Broughton Astley (GB); Niall Hugh McNamee, Guildford (GB)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 17/550,894

(22) Filed: Dec. 14, 2021

(65) Prior Publication Data

US 2022/0186471 A1 Jun. 16, 2022

(30) Foreign Application Priority Data

Dec. 14, 2020 (GB) ..... 2019672
Jul. 14, 2021 (GB) ..... 2110140

(51) Int. Cl.
*E02F 9/22* (2006.01)
*E02F 3/40* (2006.01)

(52) U.S. Cl.
CPC ..... *E02F 9/2221* (2013.01); *E02F 9/2225* (2013.01); *E02F 9/2267* (2013.01); *E02F 9/2278* (2013.01); *E02F 3/405* (2013.01)

(58) Field of Classification Search
CPC ..... E02F 9/2221; E02F 9/2278; E02F 3/405
See application file for complete search history.

(56) References Cited

U.S. PATENT DOCUMENTS 4,731,999 A 3/1988 Niemiec
5,235,809 A * 8/1993 Farrell ..... E02F 9/221 60/494

(Continued)

FOREIGN PATENT DOCUMENTS

CN 201443544 U 4/2010
CN 201787308 U 4/2011

(Continued)

OTHER PUBLICATIONS

Great Britain Search Report related to Application No. 2019672.1; dated May 5, 2021.

*Primary Examiner* — Thomas E Lazo

(57) ABSTRACT

An excavator or other work machine includes a tilting bucket operated by a hydraulic actuator controlled by a bucket control valve responsive to control signals including a bucket shake control signal, which causes the bucket to move repeatedly in the rack and dump directions to shake debris from the bucket in a bucket shake operation. The actuator is powered by pressure from a hydraulic pump, and a control system includes an unloader valve to relieve pressure from the supply line to unload the pump when there is no demand for power. The control system is arranged to maintain a constant pressure signal in a load sensing line, to maintain the unloader valve constantly in a closed condition, for the duration of the bucket shake operation. This may be achieved by pressurising an actuator of a quick coupler to lock the bucket to the machine.

10 Claims, 2 Drawing Sheets

(56) References Cited

U.S. PATENT DOCUMENTS

| | | | | |
|---|---|---|---|---|
| 6,757,992 | B1 * | 7/2004 | Berger | E02F 3/405 701/50 |
| 7,114,747 | B2 * | 10/2006 | Dix | E02F 9/085 280/764.1 |
| 7,316,112 | B2 | 1/2008 | Becker | |
| 7,434,838 | B2 * | 10/2008 | Dix | E02F 9/085 280/764.1 |
| 7,571,604 | B2 * | 8/2009 | Vigholm | E02F 9/221 700/75 |
| 7,726,125 | B2 * | 6/2010 | Brinkman | E02F 9/2296 60/452 |
| 7,866,149 | B2 * | 1/2011 | Brinkman | F15B 21/082 60/378 |
| 8,869,520 | B2 * | 10/2014 | Vigholm | E02F 9/2235 60/459 |
| 2018/0100290 | A1 | 4/2018 | Greer | |
| 2019/0093310 | A1 | 3/2019 | Kenkel et al. | |

FOREIGN PATENT DOCUMENTS

| | | | |
|---|---|---|---|
| EP | 1526221 | | 4/2005 |
| EP | 2339073 | A1 | 6/2011 |
| JP | 10115365 | A | 5/1998 |
| JP | 3151565 | B2 | 4/2001 |
| KR | 20110023285 | A | 3/2011 |
| WO | 2009067050 | | 5/2009 |

* cited by examiner

HYDRAULIC CONTROL SYSTEM AND METHOD FOR A BUCKET SHAKE OPERATION IN A WORK MACHINE WITH A HYDRAULIC PUMP AND UNLOADER VALVE

CROSS-REFERENCE TO RELATED APPLICATIONS

This application claims priority under 35 USC § 119 and the Paris Convention to Great Britian Patent Application 21101401.7 filed on Jul. 14, 2021 and Great Britian Patent Application 2019672.1 filed on Dec. 14, 2020.

TECHNICAL FIELD

This invention relates to hydraulic power systems in work machines (e.g. excavators) having a bucket that can tilt between a rack (upwardly facing) position and a dump (downwardly facing) position, where the machine includes a hydraulic pump and an unloader valve.

BACKGROUND

Such systems often include a load sensing (LS) network to control the operation of the pump so as to reduce input energy when little power is demanded by the various hydraulic actuators and motors in the machine, and to increase power when pressure must be maintained in the supply line from the pump at a higher flow rate to drive one or more of the actuators or motors in use. The LS network carries a pressure signal (referred to herein as LS pressure) responsive to the demand for pressure, which controls the operation of the pump.

The pressure signal can be derived simply by connecting the hydraulic lines of the LS network to the hydraulic lines that supply pressure to each actuator or motor from its respective control valve; thus, when the valve is opened, supply pressure is applied to the actuator or motor and simultaneously to the LS network.

Hydraulic pressure can be supplied from a variable displacement pump, e.g. a piston pump where displacement is governed by the position of a swash plate controlled by LS pressure. In this case, low LS pressure will reduce pump displacement so that the pump can continue to rotate without elevating pressure in the main supply line.

However, variable displacement pumps are complex and expensive, and it is often preferred to use a simpler, fixed displacement pump such as a gear pump. In such systems, in order to provide a simple transmission to drive the pump at a constant speed corresponding to the speed of the prime mover, it is necessary to provide an unloader valve in the main supply line from the pump. When pressure is demanded by an actuator, LS pressure goes high. The high LS pressure closes the unloader valve which allows pressure to build in the main supply line to normal operating pressure, so that the pump (hence, also the prime mover) works harder to maintain the flow to the actuator at normal operating pressure. When demand ceases, LS pressure goes low and allows the unloader valve to open at a lower, idling pressure (which can be set, for example by a 10 bar bias spring) to relieve the pressure in the main supply line, so that the fixed displacement pump can continue to rotate with the prime mover under minimal load.

In machines with a tilting bucket, it is common for mud and other debris to stick to the bucket in use. The machine operator will move the bucket rapidly in the rack and dump directions so that the bucket shakes vigorously to dislodge the debris.

In smaller machines, this can be accomplished by moving the joystick (which controls movement of the bucket) rapidly and repeatedly between the rack and dump command positions. In more sophisticated machines, to make this operation easier for the operator, a separate bucket shake control can be provided which, when actuated by the operator, causes the bucket to move in this pattern.

The user input (whether a series of alternating joystick signals, or a dedicated bucket shake control output signal) will cause movement of a valve, e.g. a valve spool, which applies the hydraulic pressure from the supply line to the bucket actuator or actuators to perform this rapid, alternating rack-dump-rack-dump movement of the bucket.

For example, in one common arrangement, the joystick will send an electrical signal to a solenoid actuator, which operates a pilot valve, which sends pilot pressure to the hydraulic actuator of the main bucket control spool valve, which sends the main supply pressure to the bucket actuator or actuators. The main supply pressure applied to the bucket actuator is also applied, via the LS network, to close the unloader valve, so that the pump (hence, also the primer mover) works harder to maintain normal operating pressure in response to the demand for power to move the bucket.

In practice, it has been found that this arrangement sometimes can be less than satisfactory, as further discussed below under the heading: "Industrial Applicability".

SUMMARY OF THE DISCLOSURE

In a first aspect, the present disclosure provides a control system for a machine.

The machine includes a hydraulic pump for supplying hydraulic pressure to a supply line; a bucket; at least one bucket actuator operable by the hydraulic pressure to tilt the bucket between an upwardly facing, rack position and a downwardly facing, dump position; and at least one user control operable by a user to produce control signals, the control signals including a bucket shake control signal.

The control system includes an unloader valve having an unloader valve actuator. The unloader valve is openable in use to relieve the hydraulic pressure from the supply line to unload the hydraulic pump, and closable by the unloader valve actuator.

The control system further includes a load sensing line arranged to apply a pressure signal, responsive to demand for hydraulic power, to the unloader valve actuator, to close the unloader valve to maintain the hydraulic pressure in the supply line.

The control system further includes a bucket control valve operable, in use, by the control signals to apply the hydraulic pressure from the supply line to the at least one bucket actuator. The bucket control valve is operable, in use, responsive to the bucket shake control signal to cause the at least one bucket actuator to perform a bucket shake operation, the bucket shake operation being a repeated movement of the bucket, alternately towards the rack and dump positions, to shake debris from the bucket.

The control system is arranged to maintain a constant pressure signal in the load sensing line, to maintain the unloader valve constantly in a closed condition, for a duration of the bucket shake operation.

In a related aspect, the disclosure provides a machine having a control system, as described above.

In another aspect, the present disclosure provides a method of controlling such a machine.

The method includes operating the bucket control valve, responsive to the bucket shake control signal, to cause the at least one bucket actuator to perform the bucket shake operation; and maintaining a constant pressure signal in the load sensing line, to maintain the unloader valve constantly in a closed condition, for a duration of the bucket shake operation.

BRIEF DESCRIPTION OF THE DRAWINGS

Further features and advantages will be evident from the illustrative embodiments which will now be described, purely by way of example and without limitation to the scope of the claims, and with reference to the accompanying drawings, in which:

Reference numerals and characters appearing in more than one of the figures indicate the same or corresponding elements in each of them.

DETAILED DESCRIPTION

Figure 3:
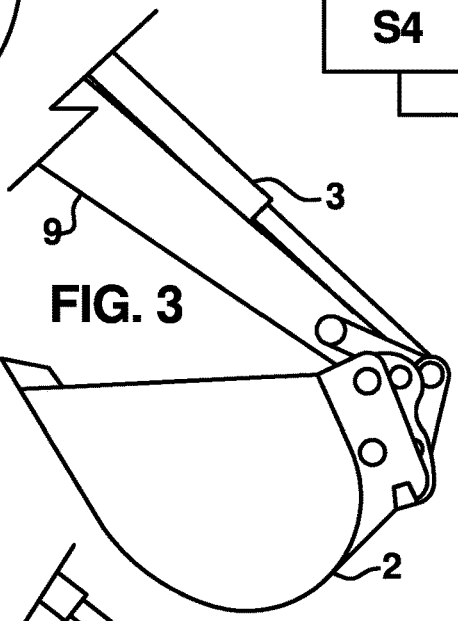
FIG. 3 shows the bucket of the machine in the rack position.
Figure 4:
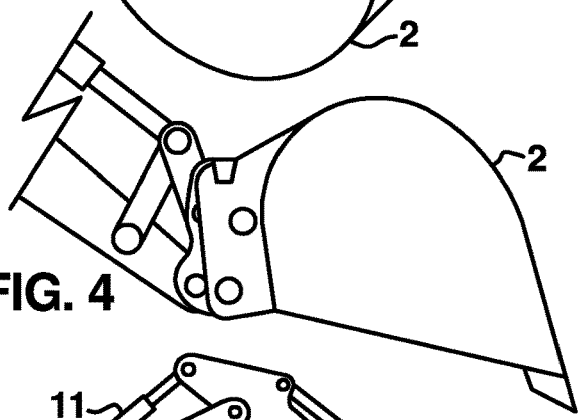
FIG. 4 shows the bucket in the dump position.
Figure 2:
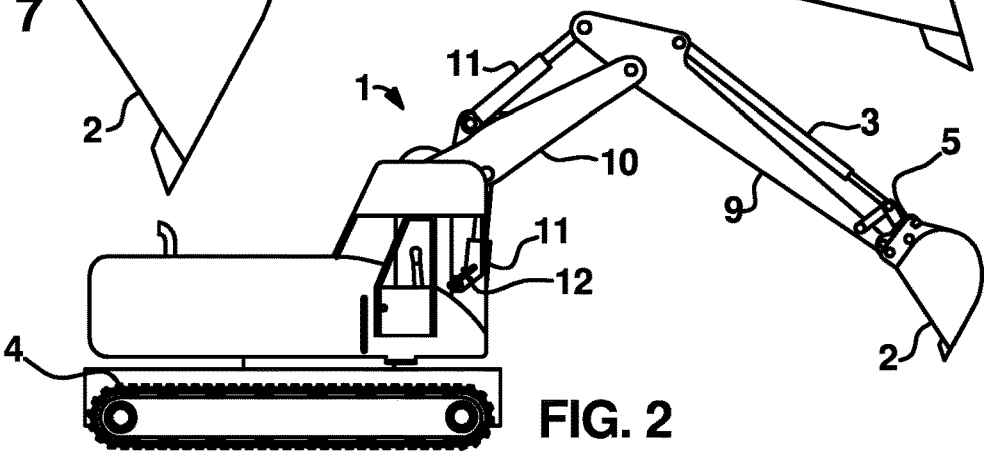
FIG. 2 shows the machine.

Referring to FIG. 2, a machine 1 includes a bucket 2 and at least one bucket actuator 3 which is operable by hydraulic pressure to tilt the bucket 2 in opposite, rack and dump directions between an upwardly facing, rack position (FIG. 3) and a downwardly facing, dump position (FIG. 4).

The machine 1 may be configured as a steerable land vehicle which is mounted on wheels or tracks 4 and may be, for example, an excavator (as illustrated) or a backhoe loader. By way of example, the machine may have a gross weight in excess of 1.5 tonnes, or 5 tonnes, or 10 tonnes, or 20 tonnes, up to as much as 100 tonnes or more.

Figure 1:
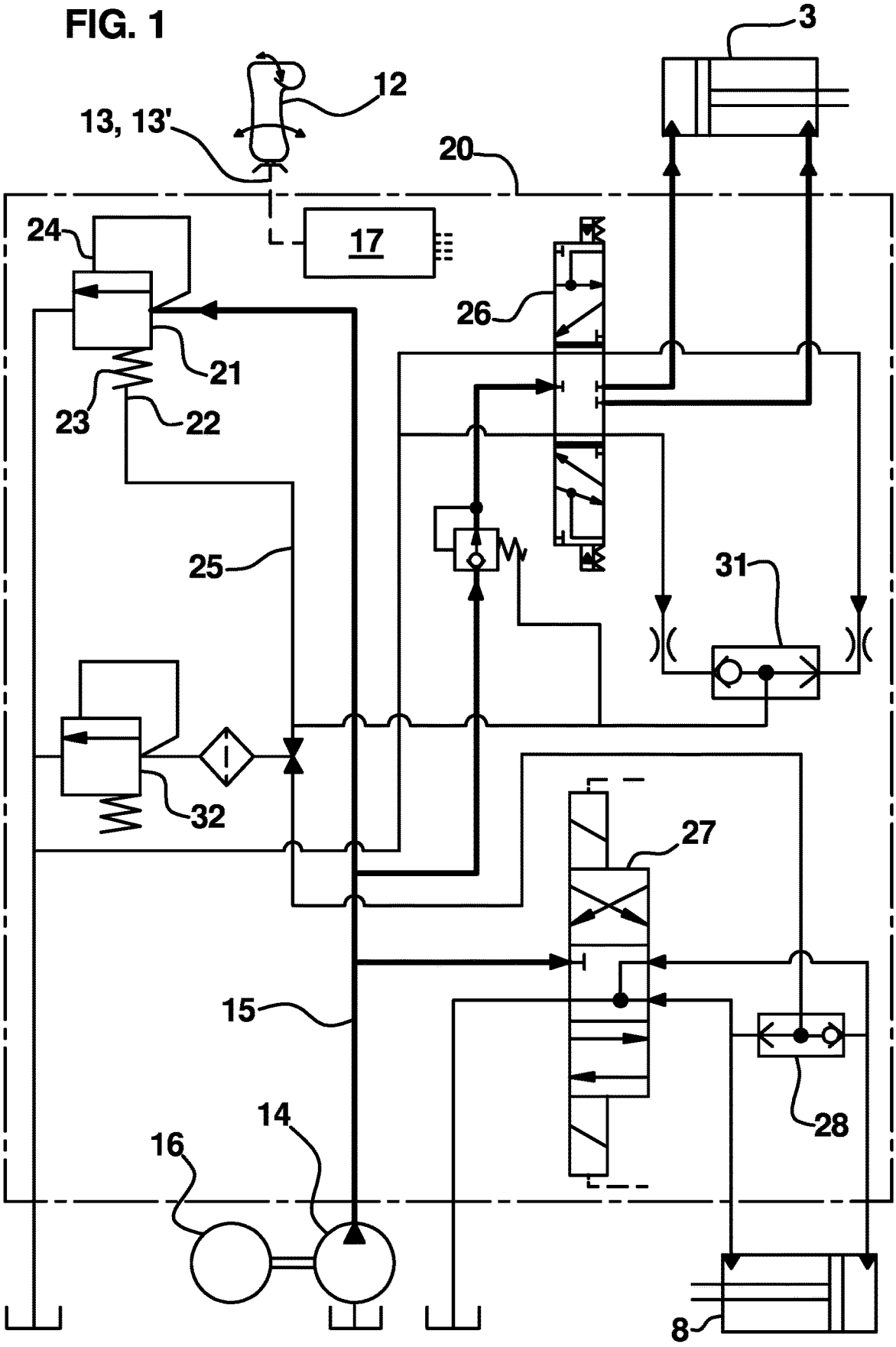
FIG. 1 shows key elements of a machine including a control system, in accordance with an embodiment.
Figure 5:
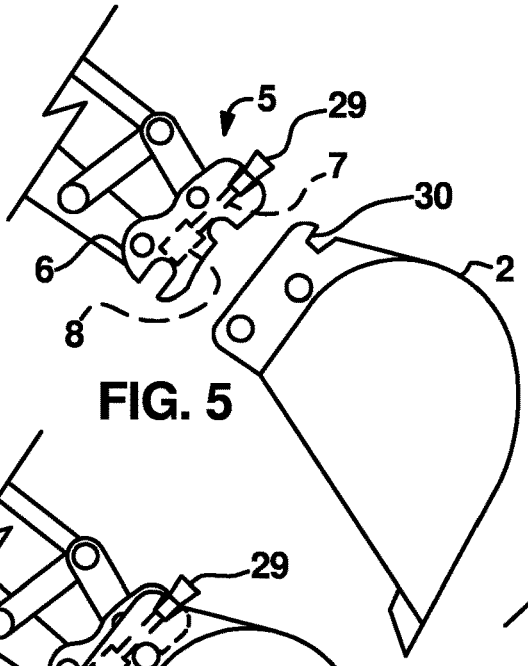
FIG. 5 shows the bucket detached from the mount.
Figure 6:
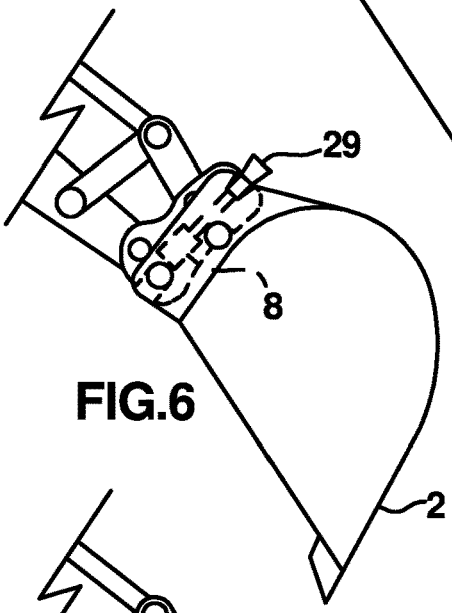
FIG. 6 shows the bucket connected to the mount with the coupling mechanism in the release position.
Figure 7:
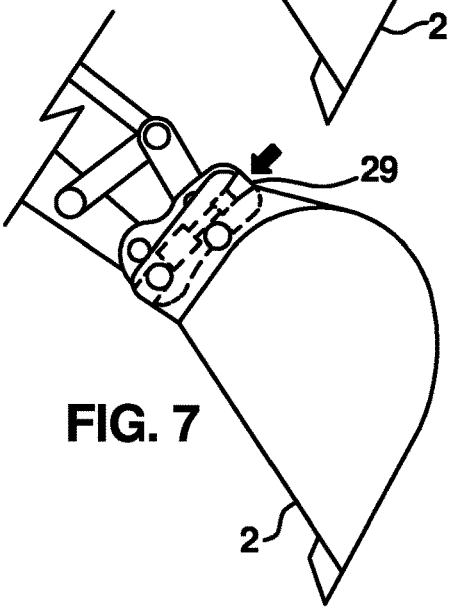
FIG. 7 shows the bucket connected to the mount with the coupling mechanism in the locked position.

Referring also to FIGS. 5-7, the bucket 2 may be mounted on the machine by means of a quick coupler 5 as well known in the art, comprising a mount 6 and a coupling mechanism 7 operated by at least one second actuator 8 to selectively lock the bucket to the mount. The mount 6 may be arranged at the distal end of a first arm or stick 9, which in turn is mounted at the distal end of a second arm or boom 10, with both arms 9, 10 being movable in rotation by hydraulic actuators 11. In the illustrated example, the bucket actuator 3 is a hydraulic ram mounted on the stick 9 to swivel the mount 6. The bucket may be used for digging or moving loose material in the vicinity of the machine, and may be interchangeable with other tools, for example, another bucket, a hydraulic breaker or a grab.

Referring to FIG. 2, the machine also includes at least one user control, which as illustrated may include a joystick 12. The at least one user control, e.g. joystick 12, is operable by a user to produce control signals 13. The control signals include a bucket shake control signal 13'.

The joystick 12 can be moved in opposite directions, as indicated by the arrows, to generate bucket rack and dump control signals, i.e. signals that command the bucket to move respectively to the rack and dump positions. Rapid and repeated movement of the joystick 12, by the operator, between its opposite positions on one axis of movement will thus produce the bucket shake control signal 13' as a series of alternate, repeated rack and dump signals. Alternatively or additionally, the user controls may include a dedicated bucket shake control (not shown), such as a button, which generates the bucket shake control signal 13' when activated by the user without requiring rapid and repeated user input.

The machine also includes a hydraulic pump 14 for supplying hydraulic pressure to a supply line 15. In this specification, a "line" means a fluid pathway that conveys hydraulic pressure, or a plurality of such fluid pathways that are interconnected to convey hydraulic pressure between multiple points, often referred to as a "network".

The hydraulic pump 14 may be a fixed displacement pump, for example, a gear pump. The pump 14 may be driven in rotation by an internal combustion engine 16 or other prime mover. The fixed displacement pump 14 may be coupled to the prime mover 16 in fixed ratio, which is to say, it may be driven by the prime mover at a speed that is fixed relative to the speed of the prime mover.

The machine further includes a control system 20, which includes an unloader valve 21, a load sensing line 25, and a bucket control valve 26.

The unloader valve 21 is openable in use, for example, by the hydraulic pressure produced by the pump 14 in the supply line 15, to relieve the hydraulic pressure from the supply line 15 to unload the hydraulic pump 14, and is closable by an unloader valve closing actuator 22. A bias spring 23 may act in the same (closing) direction as the closing actuator 22 in opposition to an opening actuator 24 which is energised by the pressure in the supply line 15, so that when the closing actuator 22 is not energised, the unloader valve 21 opens to relieve pressure from the supply line 15 when the pressure exceeds the bias force of the spring 23, which may be for example about 10 bar.

The load sensing line 25 may form a network that is arranged to convey hydraulic pressure from multiple points in the system, indicative of a demand for hydraulic power from any element of the machine, for example, from hydraulic motors that drive the tracks 4 or from any of the hydraulic actuators 3, 8, 11. In this specification, hydraulic pressure in the load sensing line is also referred to as a "pressure signal" or "LS signal", and the load sensing line 25 is referred to for convenience as the "LS line" or "LS network".

The LS line 25 is arranged to apply a pressure signal, responsive to demand for hydraulic power, to the unloader valve closing actuator 22, to close the unloader valve 21 to maintain the hydraulic pressure in the supply line 15.

The bucket control valve 26 may be a direction control spool valve, as illustrated, and is operable, in use, either directly or indirectly by the control signals 13, 13' to apply the hydraulic pressure from the supply line 15 to the at least one bucket actuator 3. In particular, the bucket control valve 26 is operable, responsive to the bucket shake control signal 13', to cause the at least one bucket actuator 3 to perform a bucket shake operation, which is a repeated movement of the bucket 2, alternately between the rack and dump positions, which is to say, alternately in the rack and dump directions towards the rack and dump positions, to shake debris from the bucket. During the bucket shake operation, the bucket may move from the rack position to the dump position and back again, or may move through a more limited range of movement in-between the rack and dump positions. The bucket or bucket actuator may engage a stop in either or both of the rack and dump positions to generate an impact which assists in detaching debris from the bucket, or the shaking action may be accomplished without hitting the stops. For example, the bucket may move repeatedly from the dump position through a short distance towards the rack position and then back to the dump position.

The control signals 13, 13' may be electrical signals, and the control system may include an electronic controller 17 which receives the electrical signals and, responsive thereto, controls the operation of pilot valves (not shown) which apply the hydraulic pilot pressure to the hydraulic actuators which operate a valve spool of the bucket control valve 26 and other control valves which, in turn, supply hydraulic pressure to the actuators, e.g. hydraulic cylinders 3, 11 that move the machine elements. Alternatively or additionally, the electrical signals 13, 13' may be applied directly to the solenoid or other actuators of the pilot valves. Alternatively or additionally, the electrical signals 13, 13', or electrical signals from the electronic controller 17, may be applied directly to solenoid or other electrical actuators that control movement of the valve spools of the valves that send pressure to the actuators that move the machine elements, as exemplified by the second actuator 8 which may be solenoid controlled as shown, although it could alternatively be controlled by pilot pressure.

Those skilled in the art will be familiar with such alternative control arrangements and will appreciate that the control system depicted in FIG. 2 can be implemented in various different ways. For clarity therefore, the control system depicted in FIG. 2 is simplified, and the electrical signal paths, pilot valves, pilot pressure supply lines and various other conventional details not essential to understanding of the present disclosure are not shown. Similarly, it will be understood that the opening and closing actuators and other functional elements of the valves are conventional, and may be implemented by appropriate configuration of a valve spool and housing or other subcomponents as well known in the art, for which reason they are not all illustrated in detail.

The control system 20 is arranged to maintain a constant pressure signal in the load sensing line 25, to maintain the unloader valve 21 constantly in a closed condition, for the duration of the bucket shake operation (i.e. until the bucket shake operation ceases). By a constant pressure signal is meant a signal that has a constant effect insofar as it maintains the unloader valve in a closed condition; which is to say, a signal that does not fluctuate, or that fluctuates in a manner or to a degree that does not cause the unloader valve 21 to open.

The control system 20 may be arranged to maintain the constant pressure signal while the bucket shake control signal 13' persists, and to discontinue the constant pressure signal when the bucket shake control signal 13' ceases.

Alternatively, for example if the bucket shake control signal 13' is generated by a dedicated bucket shake control that only requires a single operation by the user, then the control system 20 may be arranged to maintain the constant pressure signal for a predefined time period (e.g. responsive to a timer) which is triggered by receiving the bucket shake control signal 13', and which also defines the duration of the bucket shake operation. For example, the electronic controller 17 could include a program stored in non-transient memory which, when executed on a processor of the electronic controller, responsive to the bucket shake control signal 13', commands the bucket control valve 26 to perform the bucket shake operation, and also controls the operation of one or more hydraulic valves of the control system 20 to maintain the constant pressure signal for the duration of the bucket shake operation.

As discussed above, the bucket shake control signal 13' may consist of a series of alternate control signals produced by repeated operation of the at least one user control, by the user—for example, by moving the joystick 12 rapidly and repeatedly between its opposite limit positions on the axis of movement that controls the tilt function of the bucket 2. In this case, the control system 20 may be arranged to maintain the constant pressure signal in the load sensing line responsive to repetition of such alternate control signals at a frequency above a threshold frequency. For example, the threshold frequency could be defined by a certain number of transitions of the joystick 12 between the rack and dump position within a defined time period; for example, three transitions within a 500 mS time period. Additionally, the control system 20 may be arranged to maintain the constant pressure signal while the bucket shake control signal 13' continues to satisfy the defined criterion over a rolling time period, and to discontinue the constant pressure signal when the criterion is no longer satisfied, which is to say, when the bucket shake control signal 13' ceases—for example, when the number of transitions falls below three over the immediately preceding 500 mS time period.

Where the bucket shake control signal 13' consists of a series of alternate electrical control signals, the electronic controller 17 may be arranged to monitor the electrical signals and to determine whether the electrical signals are repeated at a frequency above the threshold frequency.

Figure 8:
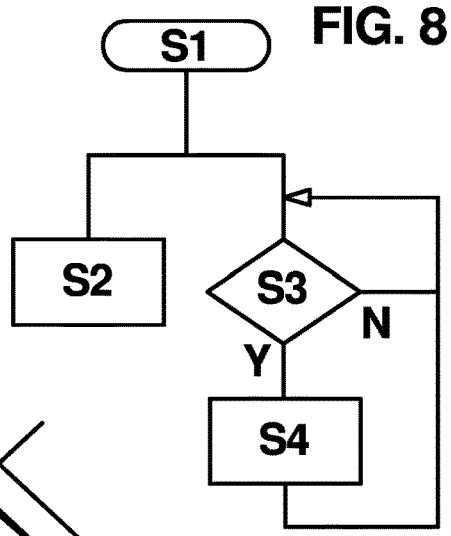
FIG. 8 is a flowchart illustrating an embodiment of the method.

FIG. 8 illustrates an example control sequence to implement the method of the disclosure.

The sequence begins at step S1 with the bucket shake control signal 13'.

At step S2, the method continues with operating the bucket control valve 26 (e.g. electrically and/or hydraulically by pilot pressure), responsive to the bucket shake control signal 13', to cause the at least one bucket actuator 3 to perform the bucket shake operation.

The method includes, at step S4, maintaining a constant pressure signal in the load sensing line 25, to maintain the unloader valve 21 constantly in a closed condition, for a duration of the bucket shake operation. Step S4 may occur slightly before or after, or simultaneously with, step S2.

Where the bucket shake control signal 13' consists of a series of alternate control signals, as discussed above, the method may include, at step S3, determining (e.g. by electronic controller 17, if they are electrical signals), whether the alternate control signals are repeated at a frequency above the threshold frequency. If yes (Y), the method continues to step S4. If no (N), the sequence returns to S3, for example, by the electronic controller 17 continuing to monitor the control signals 13 to determine whether they are individual rack or dump signals or whether they are repeated rapidly enough to constitute a bucket shake control signal 13'.

The control system 20 may be arranged to maintain the constant pressure signal in the LS line in any convenient way. One way to achieve this is by controlling the operation of a second actuator responsive to the bucket shake control signal 13', as will now be described.

The machine 1 may further include at least one second actuator which is operable by the hydraulic pressure. In the illustrated example, the at least one second actuator 8 is arranged in the mount 6 to operate the coupling mechanism 7, although alternatively it could be any hydraulic actuator of the machine that can be constantly pressurised to a limit position during the bucket shake operation.

The control system 20 includes a second actuator control valve 27 which is operable to apply the hydraulic pressure from the supply line 15 to the at least one second actuator 8. The LS line is arranged to apply the hydraulic pressure from the supply line, when applied to the at least one second actuator 8, as the pressure signal to the unloader valve closing actuator 22. As illustrated, this can be achieved by taking the LS pressure signal from a shuttle valve 28 arranged to communicate with the lines that supply pressure from the second actuator control valve 27 to the second actuator 8.

The control system 20 may be arranged to operate the second actuator control valve 27 (e.g. by a signal from the electronic controller 17, responsive to identifying the bucket shake control signal 13'), to apply the hydraulic pressure from the supply line 15 constantly to the at least one second actuator 8 and, via the load sensing line 25, as the pressure signal to the unloader valve closing actuator 22, for the duration of the bucket shake operation.

Referring now to FIGS. 5, 6 and 7, when the bucket 2 is detachably connected to the mount 6 of the quick coupler (as shown in FIGS. 6 and 7), the at least one second actuator 8 may be operable to move the coupling mechanism 7 selectively between a locked position (FIG. 7), in which the bucket 2 is locked to the mount 6 by the coupling mechanism 7, and a release position (FIG. 6) in which the bucket 2 is unlocked from the mount 6, allowing it to be removed from mount as shown in FIG. 5. In the illustrated example, the second actuator 8 is a hydraulic cylinder arranged in the mount 6, and the coupling mechanism 7 includes a wedge 29 which is urged by the second actuator 8 to engage in a recess 30 in the bucket 2 in the locked position. Other arrangements are possible, as known in the art.

The control system is arranged to operate the second actuator control valve 27, to apply the hydraulic pressure from the supply line 15 to the at least one second actuator 8, to urge the coupling mechanism 7 constantly towards the locked position for the duration of the bucket shake operation. Thus, the piston of the hydraulic cylinder is urged to its limit position, wherein the wedge 29 is engaged in the recess 30, and is maintained in this limit position for the duration of the bucket shake operation.

It will be understood therefore that the novel method may further include operating the second actuator control valve 27, to apply the hydraulic pressure from the supply line 15 constantly to the at least one second actuator 8 and, via the load sensing line 25, as the LS pressure signal to the unloader valve closing actuator 22, for the duration of the bucket shake operation. The method may further include operating the second actuator control valve 27, to apply the hydraulic pressure from the supply line 15 to the at least one second actuator 8, to urge the coupling mechanism 7 constantly towards the locked position for the duration of the bucket shake operation.

Another shuttle valve 31 may be arranged to communicate with the lines that supply pressure from the bucket control valve 26 to the bucket actuator 3, which supplies a LS signal to the LS line 25 when the bucket is commanded to or towards the rack or dump position. This LS signal ensures that normal hydraulic pressure is maintained in the supply line 15 during the rack and dump operations, and will be applied also during the bucket shake operation. However, although the LS signal from shuttle valve 31 is effective in maintaining supply pressure during normal rack and dump movements of the bucket 2, as further discussed below, the constant LS signal applied in accordance with the disclosure, e.g. from shuttle valve 28, is found to be more reliable in maintaining the unloader valve 21 in the closed position during the bucket shake operation.

The control system 20 may include a pressure relief valve 32 for the LS network and many other conventional elements which, although not all illustrated, will be evident to the skilled person.

INDUSTRIAL APPLICABILITY

The novel control system can be applied to any work machine having a tilting bucket operated by a hydraulic pump with an unloader valve, but is particularly useful in machines having a fixed displacement pump, since the unloader valve makes it possible to drive the pump at a constant speed (hence, a constant output flow rate) that is governed by the speed of the prime mover and independent of the fluctuating demand for hydraulic power, resulting in a simple system. When the unloader valve closes, the torque reaction of the pump increases, causing the prime mover to produce more power to maintain its governed speed.

The disclosure recognises that in practice, the rapid reversal of the rack-dump-rack-dump command does not allow enough time for the LS signal at the unloader valve to rise to full amplitude on each cycle. In addition, the unloader valve lags the signal, and main supply pressure lags the unloader valve. Hysteresis in the hydraulic control system thus results in an attenuated response at the unloader valve, and further attenuation of the fluctuating main supply pressure, in response to the rapidly fluctuating signal from the joystick or bucket shake control. Since the pump is unable to maintain normal operating pressure in the main supply line, the or each bucket actuator responds more slowly to the fluctuating bucket shake command than it would to a sustained, rack or dump command. In consequence, the machine operator may be frustrated by the less than vigorous response of the bucket.

By maintaining a constant pressure signal in the load sensing line to maintain the unloader valve constantly in a closed condition for a duration of the bucket shake operation, the operation of the pump maintains normal working pressure in the supply line while supplying the flow demanded by the bucket control valve to transition the bucket between the rack and dump directions. The more constant supply pressure allows the or each bucket actuator to move at normal operating speed, resulting in faster movement of the bucket between the rack and dump positions, which is to say, a more vigorous shaking action, so that debris is removed more effectively from the bucket.

Optionally, the constant pressure signal can be applied by applying hydraulic pressure to another (second) actuator of the machine to maintain it in its limit position for the duration of the bucket shake operation. Since the second actuator remains in its limit position, the constant pressure does not cause work to be done, but has the effect of raising LS pressure. In this way the constant pressure signal can be generated with few or no additional valve components, simplifying the system.

By selecting, as the second actuator, the actuator that controls the coupling mechanism that locks the bucket to its mount, the applied pressure can advantageously be used to urge the coupling mechanism constantly towards the locked position for the duration of the bucket shake operation. This can cause the coupling mechanism to hold the bucket more firmly to the mount during the bucket shake operation, which can help prevent damaging impact between the parts of the assembly.

In summary, an excavator or other work machine includes a tilting bucket operated by a hydraulic actuator controlled by a bucket control valve responsive to control signals including a bucket shake control signal, which causes the bucket to move repeatedly in the rack and dump directions to shake debris from the bucket. The actuator is powered by pressure from a hydraulic pump, and a control system includes an unloader valve to relieve pressure from the supply line to unload the pump when there is no demand for power. The control system is arranged to maintain a constant pressure signal in a load sensing line, to maintain the unloader valve constantly in a closed condition, for the duration of the bucket shake operation. This may be achieved by pressurising an actuator of a quick coupler to lock the bucket to the machine.

Many adaptations are possible within the scope of the claims.

In the claims, reference numerals and characters are provided in parentheses, purely for ease of reference, and should not be construed as limiting features.

What is claimed is:

1. A control system for a machine, the machine including:

a hydraulic pump for supplying hydraulic pressure to a supply line;

a bucket;

at least one bucket actuator operable by the hydraulic pressure to tilt the bucket between an upwardly facing, rack position and a downwardly facing, dump position; and at least one user control operable by a user to produce control signals, the control signals including a bucket shake control signal;

the control system including:

an unloader valve having an unloader valve actuator, the unloader valve being operable in use to relieve the hydraulic pressure from the supply line to unload the hydraulic pump, and closable by the unloader valve actuator;

a load sensing line arranged to apply a pressure signal, responsive to demand for hydraulic power, to the unloader valve actuator, to close the unloader valve to maintain the hydraulic pressure in the supply line; and a bucket control valve operable, in use, by the control signals to apply the hydraulic pressure from the supply line to the at least one bucket actuator;

the bucket control valve being operable, in use, responsive to the bucket shake control signal to cause the at least one bucket actuator to perform a bucket shake operation, the bucket shake operation being a repeated movement of the bucket, alternately towards the rack and dump positions, to shake debris from the bucket;

wherein the control system is arranged to maintain a constant pressure signal in the load sensing line, to maintain the unloader valve constantly in a closed condition, for a duration of the bucket shake operation.

2. The control system according to claim 1, wherein the bucket shake control signal consists of a series of alternate control signals produced by repeated operation of the at least one user control, by the user;

and the control system is arranged to maintain said constant pressure signal in the load sensing line responsive to repetition of said alternate control signals at a frequency above a threshold frequency.

3. The control system according to claim 2, wherein said alternate control signals arc electrical signals, and the control system includes an electronic controller, the controller being arranged to monitor the electrical signals and to determine whether the electrical signals are repeated at a frequency above the threshold frequency.

4. The machine including:

a hydraulic pump for supplying hydraulic pressure to a supply line;

a bucket;

at least one bucket actuator operable by the hydraulic pressure to tilt the bucket between an upwardly facing, rack position and a downwardly facing, dump position;

at least one user control operable by a user to produce control signals, the control signals including a bucket shake control signal; and a control system according to claim 1.

5. The machine according to claim 4, wherein the hydraulic pump is a fixed displacement pump.

6. The machine according to claim 4, further including at least one second actuator operable by the hydraulic pressure, the control system further including a second actuator control valve;

the second actuator control valve being operable to apply the hydraulic pressure from the supply line to the at least one second actuator;

the load sensing line being arranged to apply the hydraulic pressure, when applied to the at least one second actuator, as said pressure signal to the unloader valve actuator;

wherein the control system is arranged to operate the second actuator control valve, to apply the hydraulic pressure from the supply line constantly to the at least one second actuator and, via the load sensing line, as said pressure signal to the unloader valve actuator, for the duration of the bucket shake operation.

7. The machine according to claim 6, further including:

a mount, and a coupling mechanism;

the bucket being detachably connected to the mount;

the at least one second actuator being operable to move the coupling mechanism selectively between a locked position, in which the bucket is locked to the mount by the coupling mechanism, and a release position in Which the bucket is unlocked from the mount;

wherein the control system is arranged to operate the second actuator control valve, to apply the hydraulic pressure from the supply line to the at least one second actuator, to urge the coupling mechanism constantly towards the locked position for the duration of the bucket shake operation.

8. A method of controlling a machine, the machine including:

a hydraulic pump for supplying hydraulic pressure to a supply line;

a bucket;

at least one bucket actuator operable by the hydraulic pressure to tilt the bucket between an upwardly facing, rack position and a downwardly facing, dump position;

at least one user control operable by a user to produce control signals, the control signals including a bucket shake control signal; and a control system, the control system including:

an unloader valve having an unloader valve actuator, the unloader valve being openable in use to relieve the hydraulic pressure from the supply line to unload the hydraulic pump, and closable by the unloader valve actuator;

a load sensing line arranged to apply a pressure signal, responsive to demand for hydraulic power, to the unloader valve actuator, to close the unloader valve to maintain the hydraulic pressure in the supply line; and a bucket control valve operable, in use, by the control signals to apply the hydraulic pressure from the supply line to the at least one bucket actuator;

the method including:

operating the bucket control valve, responsive to the bucket shake control signal, to cause the at least one bucket actuator to perform a bucket shake operation, the bucket shake operation being a repeated movement of the bucket, alternately towards the rack and dump positions, to shake debris from the bucket; and maintaining a constant pressure signal in the load sensing line, to maintain the unloader valve constantly in a closed condition, for a duration of the bucket shake operation.

9. The method according to claim 8, wherein the bucket shake control signal consists of a series of alternate control signals produced by repeated operation of the at least one user control, by the user;

and said constant pressure signal is maintained in the load sensing line responsive to repetition of said alternate control signals at a frequency above a threshold frequency.

10. The method according to claim 8, wherein:

the machine further includes at least one second actuator operable by the hydraulic pressure, and the control system further includes a second actuator control valve;

the second actuator control valve being operable to apply the hydraulic pressure from the supply line to the at least one second actuator;

the load sensing line being arranged to apply the hydraulic pressure, when applied to the at least one second actuator, as said pressure signal to the unloader valve actuator;

and the method further includes:

operating the second actuator control valve, to apply the hydraulic pressure from the supply line constantly to the at least one second actuator and, via the load sensing line, as said pressure signal to the unloader valve actuator, for the duration of the bucket shake operation.

* * * * *